US009523536B2

(12) United States Patent
Baek

(10) Patent No.: US 9,523,536 B2
(45) Date of Patent: Dec. 20, 2016

(54) WASHING DRYING RACK

(75) Inventor: Yoon Su Baek, Seoul (KR)

(73) Assignee: INDUSTRY-ACADEMIC COOPERATION FOUNDATION YONSEI UNIVERSITY, Seoul (KR)

( * ) Notice: Subject to any disclaimer, the term of this patent is extended or adjusted under 35 U.S.C. 154(b) by 813 days.

(21) Appl. No.: 14/239,311

(22) PCT Filed: Nov. 9, 2011

(86) PCT No.: PCT/KR2011/008504
§ 371 (c)(1),
(2), (4) Date: Feb. 18, 2014

(87) PCT Pub. No.: WO2012/102465
PCT Pub. Date: Aug. 2, 2012

(65) Prior Publication Data
US 2014/0360043 A1 Dec. 11, 2014

(30) Foreign Application Priority Data
Jan. 28, 2011 (KR) ..... 10-2011-0008939

(51) Int. Cl.
*F26B 25/18* (2006.01)
*D06F 57/08* (2006.01)
*D06F 58/00* (2006.01)

(52) U.S. Cl.
CPC ..... *F26B 25/18* (2013.01); *D06F 57/08* (2013.01); *D06F 58/00* (2013.01)

(58) Field of Classification Search
CPC ..... F26B 25/18; D06F 57/08; D06F 58/00
See application file for complete search history.

(56) References Cited

U.S. PATENT DOCUMENTS

| | | | | |
|---|---|---|---|---|
| 3,508,664 A * | 4/1970 | Lessard | A47G 25/0657 211/89.01 |
| 9,297,583 B2 * | 3/2016 | Baek | D06F 57/00 |
| 2009/0178990 A1 * | 7/2009 | Trowsdale | D06F 57/06 211/183 |

FOREIGN PATENT DOCUMENTS

| | | | |
|---|---|---|---|
| KR | 20-1995-0009014 | U | 4/1995 |
| KR | 10-2004-0022086 | A | 3/2004 |
| KR | 10-0505157 | B1 | 7/2005 |
| KR | 10-0657053 | B1 | 12/2006 |
| KR | 10-2010-0026550 | B1 | 3/2010 |

OTHER PUBLICATIONS

International Search Report for International Application No. PCT/KR2011/008504.

* cited by examiner

*Primary Examiner* — Jiping Lu
(74) *Attorney, Agent, or Firm* — LRK Patent Law Firm

(57) ABSTRACT

A washing drying rack includes a plurality of securing hangers disposed at set intervals either transversely or longitudinally on a drying rack frame; a plurality of free-moving hangers which are formed below the fixed hangers in a number corresponding therewith, are link-connected with the corresponding fixed hangers, and perform a swinging motion using the fixed hangers as pivot shafts; and a drive means which generates power for the free-moving-hanger swinging motion.

13 Claims, 7 Drawing Sheets

WASHING DRYING RACK

TECHNICAL FIELD

The present invention relates to a washing drying rack, and more particularly, to a washing drying rack which can periodically move washing hung on the drying rack, thereby reducing a period of time to dry the washing.

BACKGROUND ART

In general, washing drying racks are focused on to naturally dry the washing hung on the drying racks. Therefore, in the rainy season that has a lot of humid days with less sunlight, it takes much time to dry the washing, and hence, there are a sanitation problem due to propagation of germs and a problem that indoor environment is deteriorated due to an unpleasant smell.

Korean Patent Publication No. 2010-26550 discloses an automatic washing drying device which can reduce drying time in order to solve the above-mentioned problems. In Korean Patent Publication No. 2010-26550, the drying device includes a blower (drying fan) disposed below a drying rack so as to artificially provide dry wind to the washing hung on a drying member.

However, according to such a conventional device, when the blower is operated to dry the washing, dust existing on the floor rises upward by wind from the blower and moves toward the washing, and hence, the washing which is being dried is dusted. Moreover, such a simple air-blowing method is not a big help to reduce drying time.

DISCLOSURE

Technical Problem

Accordingly, the present invention has been made in an effort to solve the above-mentioned problems occurring in the prior arts, and it is an object of the present invention to provide a washing drying rack which can periodically move washing hung on the drying rack, thereby reducing a period of time to dry the washing and preventing that the washing is dusted during the drying process.

Technical Solution

To achieve the above objects, the present invention provides a washing drying rack including: a plurality of fixed hangers horizontally or vertically arranged on a drying rack frame at regular intervals; a plurality of movable hangers formed below the fixed hangers in the same number as the fixed hangers, the movable hangers being connected with the fixed hangers by the medium of movable frames and performing a swing motion around the fixed hangers as pivot axes; and driving means for generating driving power for the swing motion of the movable hangers.

Moreover, the fixed hangers are rotatably restricted to both ends of the drying rack frame, and each of the movable hangers is connected with the neighboring movable hanger through a link bar in an interworking manner.

Furthermore, the movable hangers may be independently operated by a plurality of driving means, but in consideration of power consumption and the number of components, it is preferable that all of the movable hangers perform the swing motion by one driving means.

In this instance, the driving means is any one selected from a rack-and-pinion type driving means, a ball-screw type driving means, and a linear cylinder type driving means.

As another example, the driving means is a link-type driving means comprising: a driving motor; a driving link mounted on a driving shaft of the driving motor in an eccentrically rotatable manner; and a driven link, a free end of the driving link being connected with a connection link located at the front end by the medium of the driven link.

As a further example, the driving means is a cam-follower type driving means comprising: a driving motor; a cam rotatably mounted on a driving shaft of the driving motor; and a sliding bar to which front ends of the movable frames are pivotally connected at regular intervals, the sliding bar having a contact portion getting in contact with the surface of the cam.

In case of the cam-follower type driving means, a spring supporter is disposed at a point which is spaced apart from the contact portion of the sliding bar at a predetermined interval, and a spring is interposed between the spring supporter and the contact portion so as to provide restoring force by movement of the sliding bar.

It is preferable that the driving means is controlled in right and left rotation speed or in forward and reverse rotation speed.

Moreover, due to an accident that the user jams his or her finger through his carelessness or malfunction by jammed washing during the swing motion, when a load exceeding a predetermined power to the movable hangers or the fixed hangers is sensed, the load sensor senses it and outputs a command to stop the operation of the driving means or to operate the driving means in a reverse direction by changing a flow of electric current.

As a preferable example, the fixed hangers and the movable hangers are hollow pipes having spray holes or slit type injection nozzles, and the washing drying rack further includes a blower adapted for providing dry air to the inside of the fixed hangers and the movable hangers which are the hollow pipes.

In this instance, strength of drying air provided through the blower is controlled by stages according to the user's selection.

Advantageous Effects

According to the preferred embodiments of the present invention, the washing drying rack can change a ventilation area by periodically moving the washing hung on the drying rack in a different way from the conventional methods so as to smoothly circulate air by shaking the humid air layer stopping on the surface of the washing, thereby remarkably reducing drying time in the same way as natural wind blowing to the washing.

Particularly, the drying rack according to the preferred embodiments of the present invention can reduce unnecessary power consumption and realize the optimum drying conditions according to kinds of the washing by controlling the swing speed of the movable hangers. Additionally, compared with the conventional washing drying racks adopting the blowers, the drying rack according to the preferred embodiments of the present invention remarkably reduces an amount of foreign matters, such as dust, stained on the washing during the drying process.

Moreover, because the fixed hangers and the movable hangers of the drying rack are hollow pipes and dry air is provided to the fixed hangers and the movable hangers, the drying rack according to the preferred embodiments of the present invention can rapidly dry the washing even in the rainy season that has a lot of humid days with less sunlight.

EXPLANATION OF ESSENTIAL REFERENCE NUMERALS IN DRAWINGS

Figure 1:
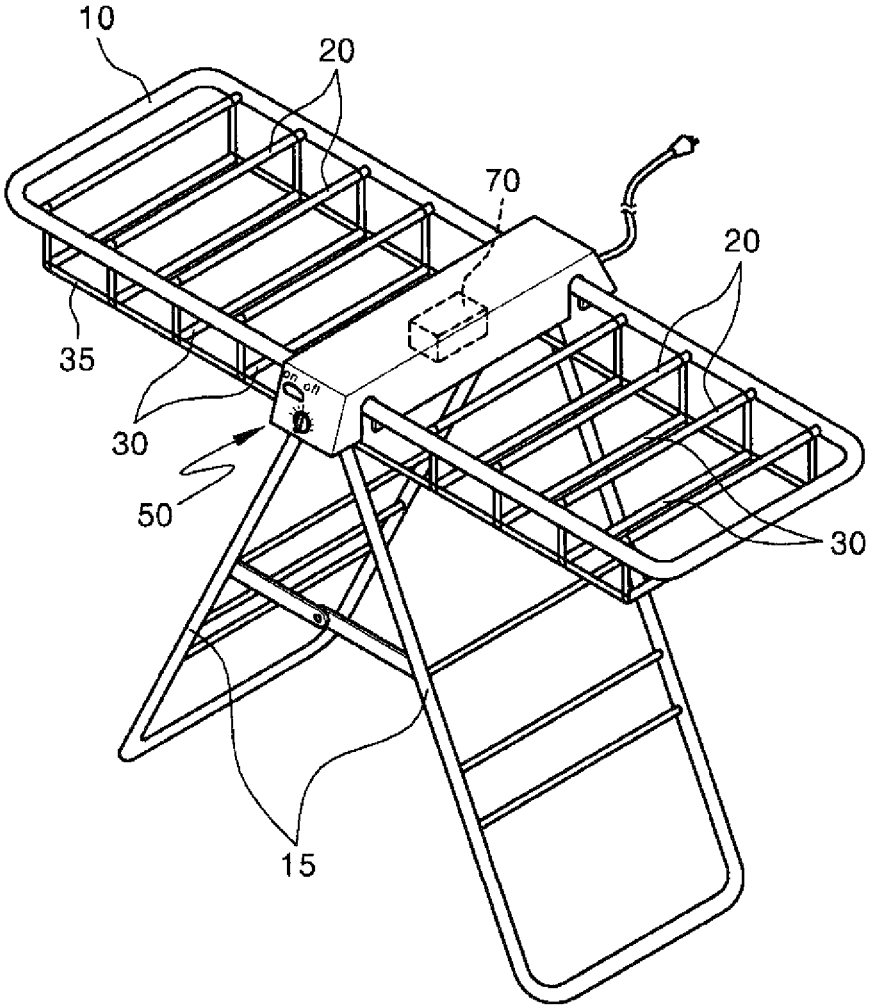
FIG. 1 is a perspective view of a washing drying rack according to a preferred embodiment of the present invention.

10: drying rack frame
15: support member
20: fixed hanger
30: movable hanger
40: driving means
50: controller
60: load sensor
70: blower

MODE FOR INVENTION

Reference will be now made in detail to the preferred embodiment of the present invention with reference to the attached drawings.

Figure 2:
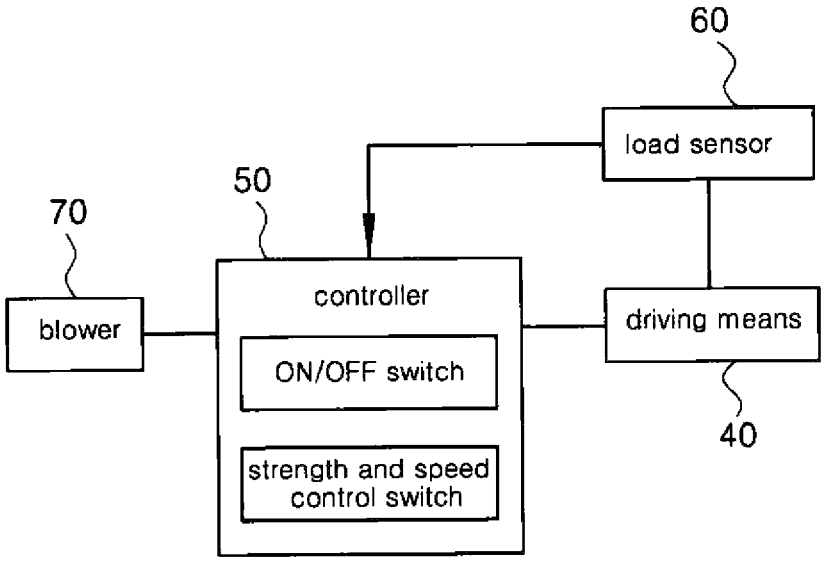
FIG. 2 is a block diagram for briefly showing the structure of the entire system of the washing drying rack according to the preferred embodiment of the present invention.

FIG. 1 is a perspective view of a washing drying rack according to a preferred embodiment of the present invention, and FIG. 2 is a block diagram for briefly showing the structure of the entire system of the washing drying rack according to the preferred embodiment of the present invention.

Referring to FIGS. 1 and 2, the washing drying rack according to the preferred embodiment of the present invention includes a drying rack frame 10. The drying rack frame 10 can be put on the ground stably through a support member 15 which is foldable, and two drying rack frames are symmetrically arranged relative to the support member 15 as shown in FIG. 1.

The drying rack frame 10 includes a plurality of fixed hangers 20 arranged horizontally or vertically and spaced apart at regular intervals so as to enable a user to hang the washing on the fixed hangers. Both ends of the fixed hanger are rotatably restricted to the drying rack frame 10. Moreover, movable hangers 30 in the same number as the fixed hangers 20 are arranged below the fixed hangers 20 and connected to the fixed numbers 20 by the medium of movable frames 25.

If the drying rack frame 10, the fixed hangers 20 and the movable hangers 30 have enough axial stiffness to prevent the washing from drooping or deforming when heavy washing is hung on the drying rack, they are not restricted in their materials and thickness. Moreover, if more washings can be hung on the drying rack to be dried, the drying rack is not limited to the structure and shape illustrated in FIG. 1.

The movable hangers 30 are connected with the fixed hangers 20 by the medium of the movable frames 25 as described above, and thus, can periodically move the washing hung on the fixed hangers 20 while performing a swing motion (pendulum movement) around the corresponding fixed hangers 20 as pivot axes when the fixed hangers 20 are rotated in forward and backward directions within a predetermined angle range.

When the washing hung on the drying rack is periodically moved by the swing motion of the movable hangers 30, it shakes a humid air layer stopping on the surface of the washing so as to generate a smooth circulation of air, such that the drying rack can give a wind effect like natural wind to the washing so as to reduce drying time.

The swing motion of the movable hangers 30 can be realized by a driving force generated from driving means 40, and the driving means 40 is not limited in structure if the driving means 40 can transmit a driving force to realize the swing motion of the movable hangers 30 relative to the fixed hangers 20.

For instance, not shown in the drawings, but when the driving means, e.g., motors, in the same number as the fixed hangers 20 are respectively mounted on the sides of the fixed hangers 20, the movable hangers 30 may be independently operated by driving forces of the motors.

In the case that the movable hangers 30 are individually and independently operated by the plural motors as described above, because it causes high power consumption and increase of the number of components, it is preferable to realize a mechanism that all of the movable hangers 30 provide the swing motion in the same direction by just one driving means.

Figure 3:
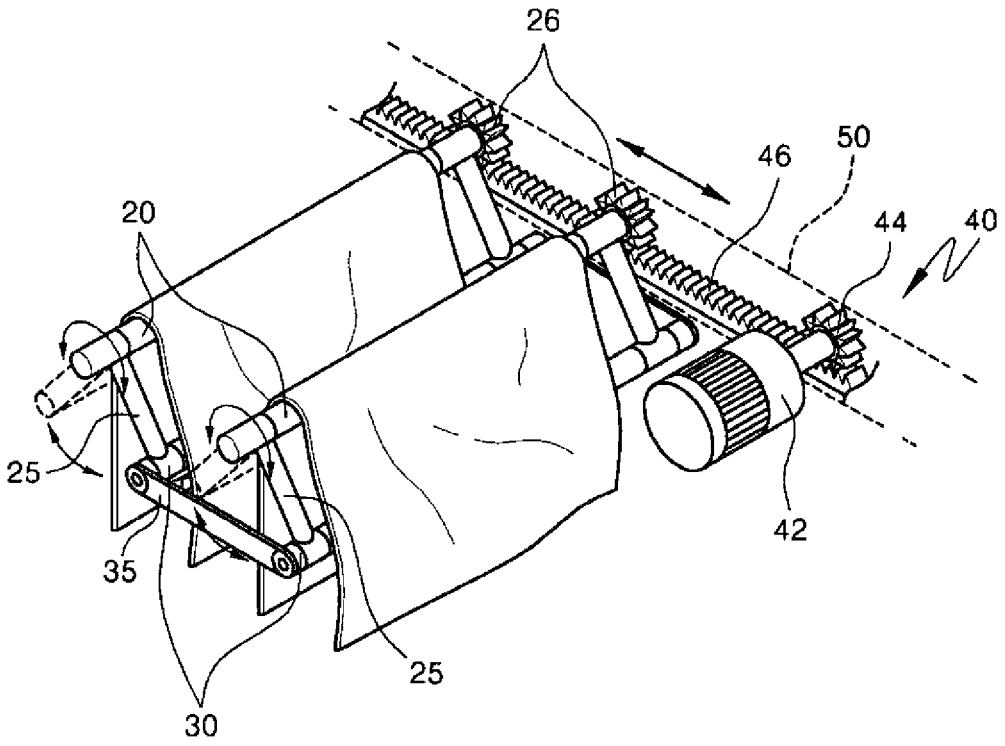
FIG. 3 is a conceptual view of operation showing a swing motion of movable hangers of the washing drying rack.

In order to realize the mechanism that all of the movable hangers 30 provide the swing motion in the same direction by just one driving means, it is preferable that a plurality of the movable hangers 30 be connected through a link bar 35 in an interworking manner so as to realize the swing motion of all of the movable hangers 30 more easily. Referring to FIG. 3, the structure to operate all of the movable hangers by one driving means will be described in brief.

FIG. 3 is a conceptual view of operation showing a swing motion of a movable hanger of the washing drying rack.

Referring to FIG. 3, the driving means 40 may be a rack-and-pinion type driving means which includes: one driving motor 42 arranged at the center; a pinion gear 44 mounted at a driving shaft of the driving motor 42; and a rack gear 46 geared with the pinion gear 44 for converting a rotational movement of the driving shaft into a rectilinear movement. In this instance, driven gears 26 geared with the rack gear 46 may be respectively mounted at front ends of the fixed hangers 20.

In case of the rack-and-pinion type driving means 40, rotary power by rotation of the driving motor 42 is converted into the rectilinear movement of the rack gear 46, and then, the rectilinear movement of the rack gear 46 is converted into a rotational movement to rotate the fixed hangers 20 through the driven gears 26, such that all of the movable hangers 30 easily perform the swing motion around the fixed hangers 20 as the pivot axes.

Figure 4:
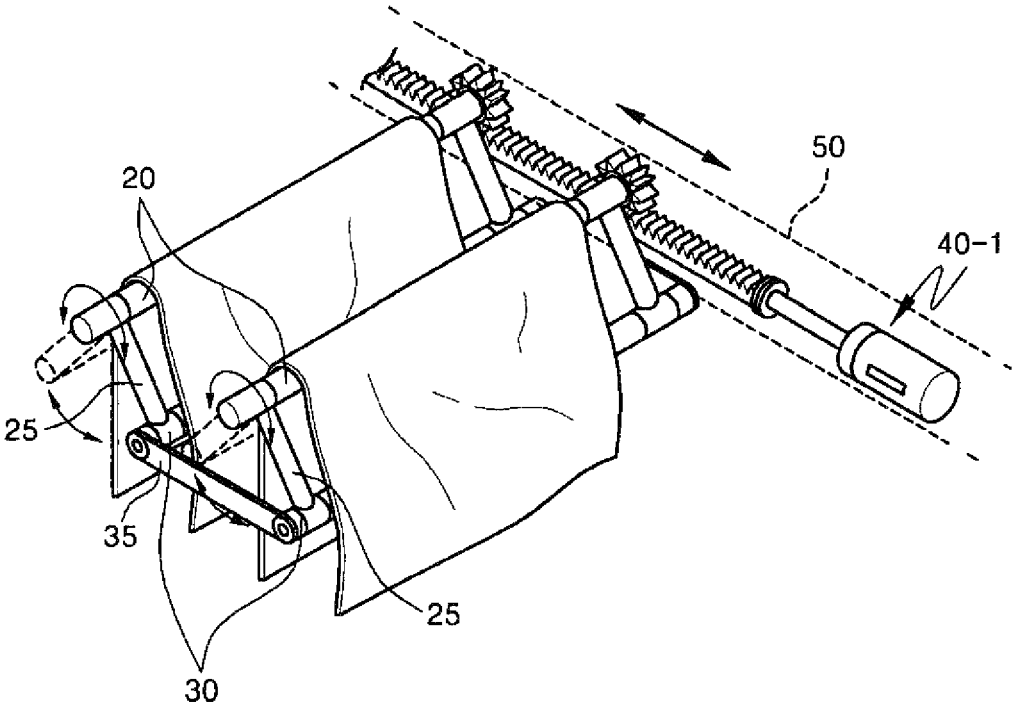
FIG. 4 is a perspective view of a washing drying rack according to another preferred embodiment of the present invention.

In this embodiment, the rack-and-pinion type driving means 40 is described, but if the driving means can convert the rotational movement into the rectilinear movement and the rectilinear movement into the rotational movement, for instance, like a ball-screw type driving means or a linear cylinder type driving means 40-1 (See FIG. 4), the driving means is not limited to the illustrated example.

Figure 5:
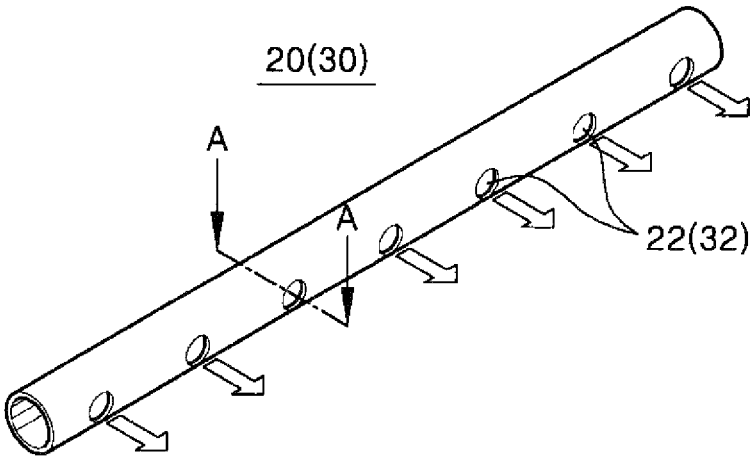
FIGS. 5 and 6 are conceptual views of operation showing a swing motion of movable hangers of the washing drying rack according to a further preferred embodiment of the present invention.

As another example, the driving means 40 may be a link-type driving means illustrated in FIG. 5. The link-type driving means 40 of FIG. 5 includes a driving motor 42-1 located at one end of the drying rack frame 10; a driving link 43 mounted on a driving shaft (no reference numeral) of the driving motor in an eccentrically rotatable manner; and a driven link 45, a free end of the driving link 43 being connected with a connection link 35 located at the front end by the medium of the driven link 45.

In the link-type driving means, an eccentric rotation of the driving link 43 by rotation of the driving motor 42-1 is converted into a pitching motion of the driven link 45 (the same as the power transmission structure of wheels of the old train), and the connection link 35 performs the swing motion by the pitching motion of the driven link 45, such that the movable hangers 30 can perform the swing motion relative to the fixed hangers 20.

Differently from the rack-and-pinion type driving means illustrated in FIG. 3, the link-type driving means can realize the swing motion just by operating the driving motor 42-1 in any one direction. That is, the link-type driving means can realize the mechanism that all of the movable hangers 30 perform the swing motion just by DC power.

Figure 6:
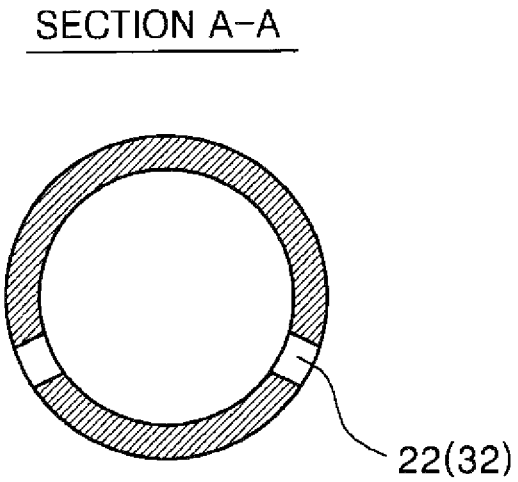

FIG. 6 is a brief diagram of driving means which is applicable to the washing drying rack according to another preferred embodiment of the present invention.

As shown in FIG. 6, the driving means 40 may be a cam-follower type driving means which includes: a driving motor 42-2; a cam 46 rotatably mounted on a driving shaft (no reference numeral) of the driving motor 42-2; and a sliding bar 48 having a contact portion 47 getting in contact with the surface of the cam 46 so as to perform a sliding motion by rotation of the cam.

In this instance, front ends of the movable frames 25 are pivotally connected to the sliding bar 48 at regular intervals, and each of the movable frames 25 has a fixed point H1 at a point which is spaced apart from the pivot point at a predetermined interval. Therefore, it is preferable that the movable frames 25 perform the swing motion relative to the corresponding fixed point H1 when the sliding bar 48 performs the rectilinear movement by rotation of the cam 46.

Particularly, in order to perform such a swing motion when the contact portion 47 of the sliding bar 48 is in continuous contact with the surface of the cam 46, a spring supporter 49*a* is disposed at a point which is spaced apart from the contact portion 47 of the sliding bar 48 at a predetermined interval, and a spring 49*b* is interposed between the spring supporter 49*a* and the contact portion 47 so as to provide restoring force for making the sliding bar 49 contact with the cam 46.

In the meantime, when the swing speed of the movable hangers 30 is regulated, unnecessary power consumption is reduced and the optimum drying condition can be realized according to kinds of the washing. Therefore, it is preferable to control the right and left rotation speed or the forward and reverse rotation speed of the driving means 40 by the user's manipulation, and for this, a lever type or button type controller 50 is disposed (See FIG. 1).

When a load sensor 60 is mounted on the driving means 40, in the case that a load exceeding a predetermined power to the movable hangers 30 or the fixed hangers 20 is sensed, the controller outputs a command to stop the operation of the driving means 40 or to operate in the reverse direction by converting a flow of electric current, so as to prevent accidents that the user jams his or her finger through his carelessness or malfunction by jammed washing during the swing motion of the movable hangers 30.

Figure 7:
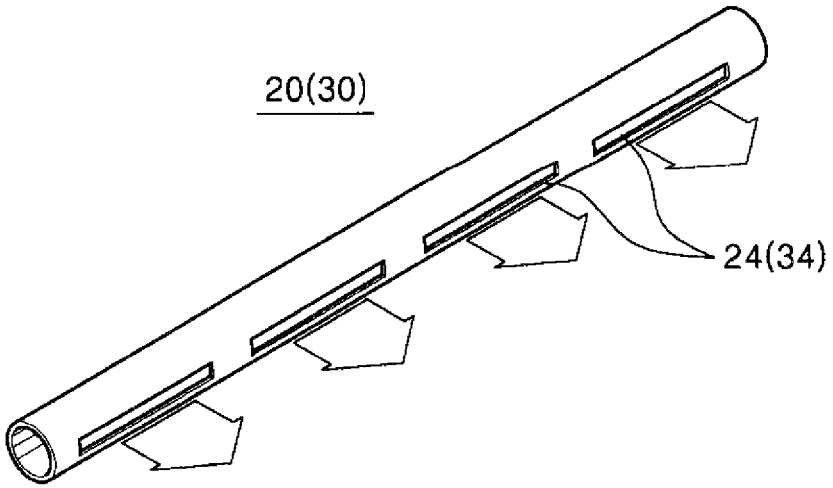
FIG. 7 is a perspective view of fixed hangers (or the movable hangers) applied to the washing drying rack of the present invention.
Figure 8:
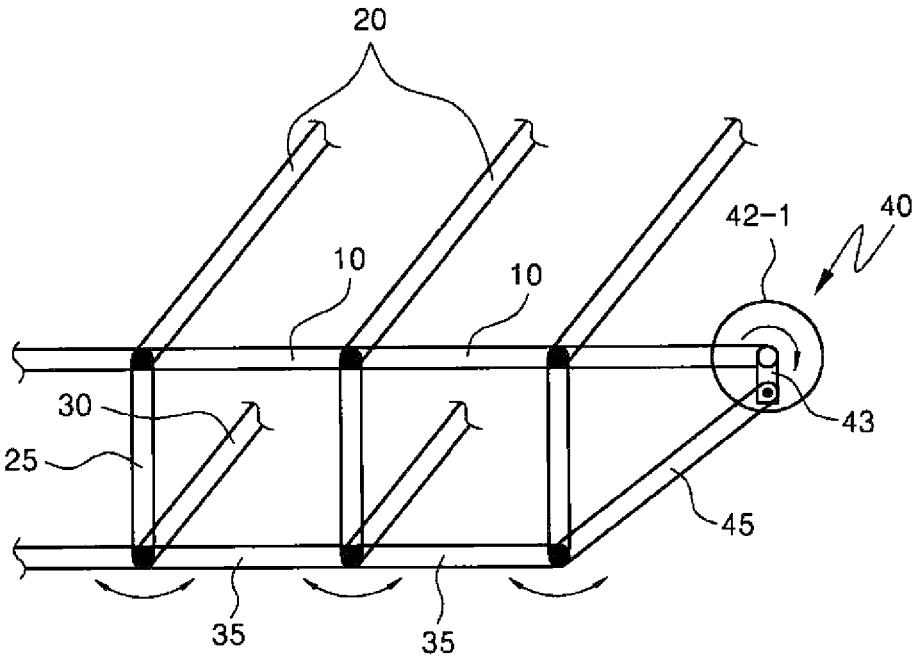
FIG. 8 is a sectional view taken along the line of A-A of FIG. 7.

FIG. 7 is a perspective view of the fixed hangers (or the movable hangers) applied to the washing drying rack of the present invention, and FIG. 8 is a sectional view taken along the line of A-A of FIG. 7. Moreover, FIG. 9 is a perspective view of fixed hangers (or movable hangers) according to another preferred embodiment of the present invention.

Figure 9:
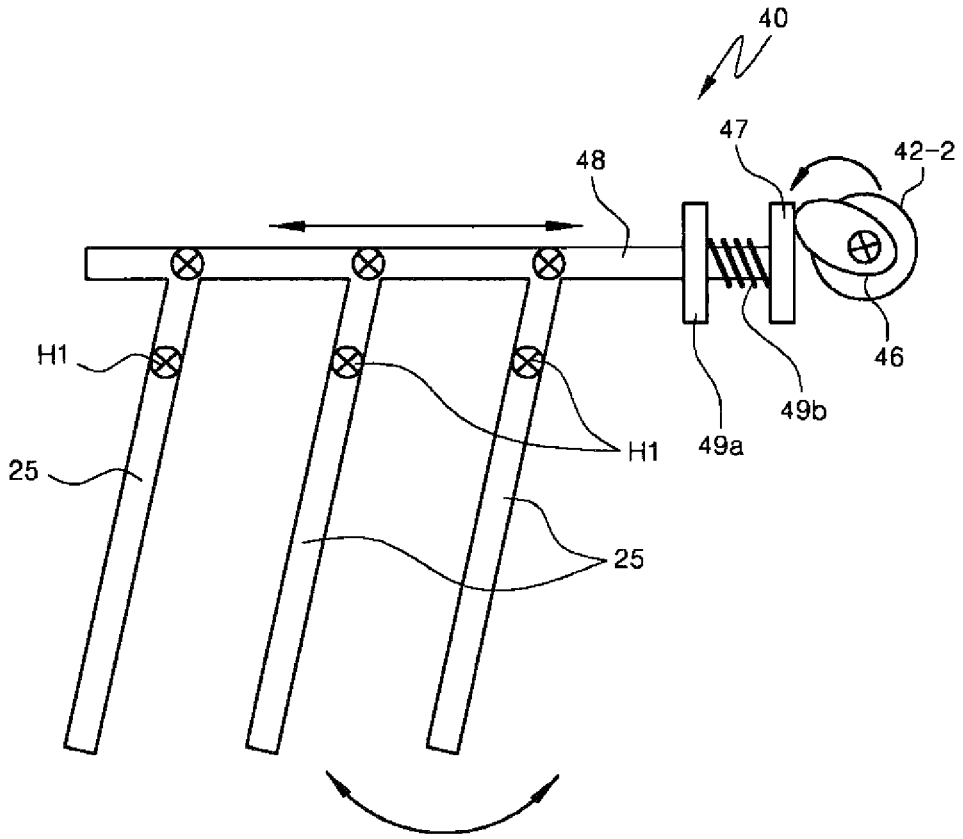
FIG. 9 is a perspective view of fixed hangers (or movable hangers) according to another preferred embodiment of the present invention.

Referring to FIGS. 7 to 9, the fixed hangers 20 and the movable hangers 30 may be hollow pipes having spray holes 22 and 32 (See FIG. 7) or slit type injection nozzles 24 and 34 (See FIG. 9), and the drying rack may further include a blower 70 for providing dry air to the inside of the fixed hangers 20 and the movable hangers 30 which are hollow.

When the dry air generated from the blower 70 is blown toward the washing through the fixed hangers 20 and the movable hangers 30, the washing hung on the drying rack is periodically moved by the swing motion and the humid air layer stopping on the surface of the washing is shaken so as to promote drying, and thus, the period of time to dry the washing is remarkably reduced.

The controller 50 can control strength of drying air provided through the blower 70 by stages according to the user's selection. Therefore, the drying rack according to the preferred embodiment of the present invention can realize the optimum drying conditions according to kinds of the washing and reduce unnecessary power consumption. Accordingly, it is preferable that strength of the blower 70 also be controlled by the user's manipulation.

According to the preferred embodiments of the present invention, the washing drying rack can periodically move the washing hung on the drying rack in a different way from the conventional methods so as to smoothly circulate air by shaking the humid air layer stopping on the surface of the washing, thereby remarkably reducing drying time in the same way as natural wind blowing to the washing.

Particularly, the drying rack according to the preferred embodiments of the present invention can reduce unnecessary power consumption and realize the optimum drying conditions according to kinds of the washing by controlling the swing speed of the movable hangers.

Moreover, because the fixed hangers and the movable hangers of the drying rack are hollow pipes and dry air is provided to the fixed hangers and the movable hangers, the drying rack according to the preferred embodiments of the present invention can rapidly dry the washing even in the rainy season that has a lot of humid days with less sunlight.

While the particular embodiments of the present invention have been particularly described in this specification of the present invention, it should be understood that there is no intent to limit the example embodiments of the present invention to the particular forms disclosed, but on the contrary, example embodiments of the invention are to cover all modifications, equivalents, and alternatives falling within the spirit and scope of the invention defined by the claims.

INDUSTRIAL APPLICABILITY

As described above, the washing drying rack can reduce drying time of the washing by periodically moving the washing hung on the drying rack, and hence, is applicable and usable in various forms not only in many households but also in various industrial fields.

The invention claimed is:

1. A washing drying rack comprising:

a plurality of fixed hangers horizontally or vertically arranged on a drying rack frame at regular intervals;

a plurality of movable hangers formed below the fixed hangers in the same number as the fixed hangers, the movable hangers being connected with the fixed hangers by the medium of movable frames and performing a swing motion around the fixed hangers as pivot axes; and driving means for generating driving power for the swing motion of the movable hangers.

2. The washing drying rack according to claim 1, wherein the fixed hangers are rotatably restricted to both ends of the drying rack frame.

3. The washing drying rack according to claim 1, wherein each of the movable hangers is connected with the neighboring movable hanger through a link bar in an interworking manner.

4. The washing drying rack according to claim 1, wherein all of the movable hangers perform the swing motion by just one driving means.

5. The washing drying rack according to claim 4, wherein the driving means is any one selected from a rack-and-pinion type driving means, a ball-screw type driving means, and a linear cylinder type driving means.

6. The washing drying rack according to claim 5, wherein the driving means is controlled in right and left rotation speed or in forward and reverse rotation speed.

7. The washing drying rack according to claim 4, wherein the driving means is a link-type driving means comprising: a driving motor; a driving link mounted on a driving shaft of the driving motor in an eccentrically rotatable manner; and a driven link, a free end of the driving link being connected with a connection link located at the front end by the medium of the driven link.

8. The washing drying rack according to claim 4, wherein the driving means is a cam-follower type driving means comprising: a driving motor; a cam rotatably mounted on a driving shaft of the driving motor; and a sliding bar to which front ends of the movable frames are pivotally connected at regular intervals, the sliding bar having a contact portion getting in contact with the surface of the cam.

9. The washing drying rack according to claim 8, wherein a spring supporter is disposed at a point which is spaced apart from the contact portion of the sliding bar at a predetermined interval, and a spring is interposed between the spring supporter and the contact portion so as to provide restoring force by movement of the sliding bar.

10. The washing drying rack according to claim 8, wherein the driving means is controlled in right and left rotation speed or in forward and reverse rotation speed.

11. The washing drying rack according to claim 1, further comprising:

a load sensor adapted for outputting a command to stop the operation of the driving means or to operate the driving means in a reverse direction by changing a flow of electric current when a load exceeding a predetermined power to the movable hangers or the fixed hangers is sensed.

12. The washing drying rack according to claim 1, wherein the fixed hangers and the movable hangers are hollow pipes having spray holes or slit type injection nozzles, and further comprising:

a blower adapted for providing dry air to the inside of the fixed hangers and the movable hangers which are the hollow pipes.

13. The washing drying rack according to claim 12, wherein strength of drying air provided through the blower is controlled by stages.

* * * * *